United States Patent [19]

Teckchandani

[11] 4,375,736

[45] Mar. 8, 1983

[54] SHOWER DOOR HAVING ADJUSTABLE PIVOT MEMBERS

[75] Inventor: Lall D. Teckchandani, Lisle, Ill.

[73] Assignee: United States Gypsum Company, Chicago, Ill.

[21] Appl. No.: 188,643

[22] Filed: Sep. 19, 1980

[51] Int. Cl.[3] ..... E05D 7/08

[52] U.S. Cl. ..... 49/388; 49/390

[58] Field of Search ..... 49/381, 383, 388, 390; 292/251.5; 160/206

[56] References Cited

U.S. PATENT DOCUMENTS

| | | | |
|---|---|---|---|
| 2,698,677 | 1/1955 | Tadd | 49/381 X |
| 2,812,965 | 11/1957 | Horvay | 292/251.5 |
| 3,583,464 | 6/1971 | Johnson, Sr. | 160/206 |
| 3,750,737 | 8/1973 | Woodward | 106/206 |
| 4,035,957 | 7/1977 | Roloff | 49/388 |

FOREIGN PATENT DOCUMENTS

| | | | |
|---|---|---|---|
| 2348376 | 4/1975 | Fed. Rep. of Germany | 49/390 |
| 2433720 | 1/1976 | Fed. Rep. of Germany | 49/388 |

*Primary Examiner*—K. Downey

*Attorney, Agent, or Firm*—Samuel Kurlandsky; Robert H. Robinson; Robert M. Didrick

[57] ABSTRACT

A pivotal door for an entrance or passageway, and particularly for shower or bathtub enclosures, comprising a plurality of frame members, a panel mounted in said frame members, a channel provided in both top and bottom frame members, and a pair of pivot members each having one end adjustably retained within one of the channels, and the other end engaged in a socket provided in the shower enclosure frame, each pivot member being arranged to be affixed at any of a plurality of positions on the channel to enable the door to be utilized with enclosures having entrances of different widths.

6 Claims, 11 Drawing Figures

SHOWER DOOR HAVING ADJUSTABLE PIVOT MEMBERS

BACKGROUND OF THE INVENTION (1) Field of the Invention

The present invention relates to doors and particularly shower or bathtub doors, and more particularly refers to doors of the type described which are mounted by means of pivot members which are adjustable and permit the door to be mounted at any of a plurality of positions, depending on the size of the enclosure opening.

(2) Description of the Prior Art

Doors for bathtubs and showers are conventionally supported by means of rollers or slides mounted at the upper edge of the doors and guided in a track or slot. In other embodiments doors are provided with pivots one of which is affixed to each of the upper and lower edges and which are pivotally mounted in sockets provided in the enclosure frame. Conventionally the pivot members are not adjustable and are fixedly mounted to the door so that doors of different sizes must be used when enclosure openings of different sizes are encountered. Doors having adjustable pivot members have been disclosed, but are generally mounted only with difficulty.

SUMMARY OF THE INVENTION

It is an object of the present invention to provide a door for the opening of a bathtub or shower enclosure which is pivotally mounted.

It is further an object to provide a door of the type described which has a rear edge which overlaps one edge of the shower or bathtub enclosure.

It is still further an object to provide a door of the type described which may be adjustably mounted so that a single door may be utilized as a closure for openings of different widths.

It is a further object to provide a structure of the type described which can be readily fabricated and which is competitive in cost with regard to prior art structures.

These and other objects, advantages and functions of the invention will be apparent upon reference to the specification and to the attached drawings illustrating a preferred embodiment of the invention, in which like parts are identified by like reference symbols in each of the views.

According to the invention, a door structure is provided having upper, lower, and side or lateral frame members, the upper and lower frame members having channels or tracks provided therein along substantially the entire length thereof, pivot members which are adjustably mounted and retained in the channels or tracks, and sockets provided in the enclosure frame for pivotally retaining the ends of the pivot members.

DESCRIPTION OF THE PREFERRED EMBODIMENTS

Figure 1:
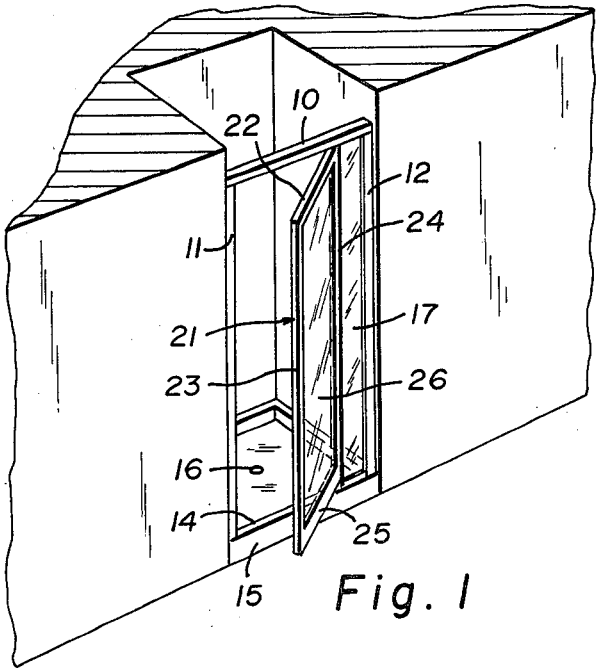
FIG. 1 is a perspective view of a shower stall having a door according to the invention mounted therein.
Figure 2:
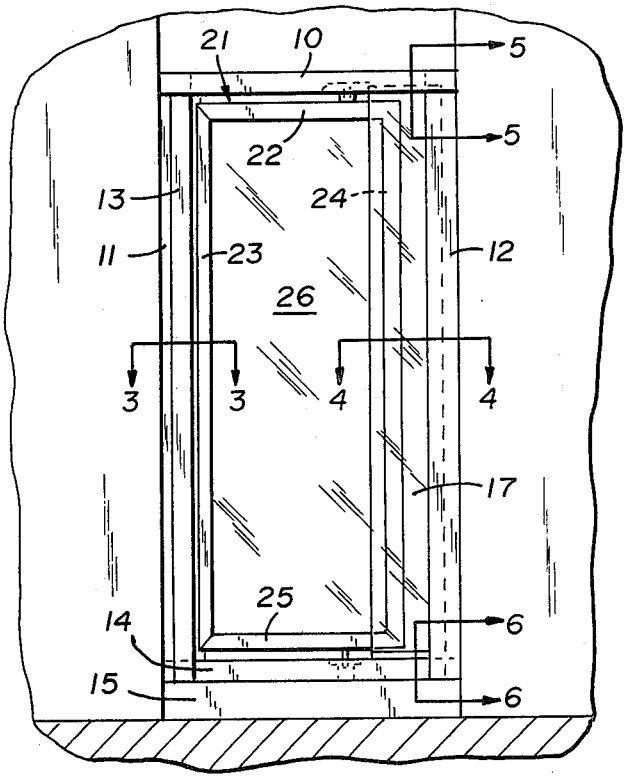
FIG. 2 is an elevational view of the structure shown in FIG. 1.
Figure 3:
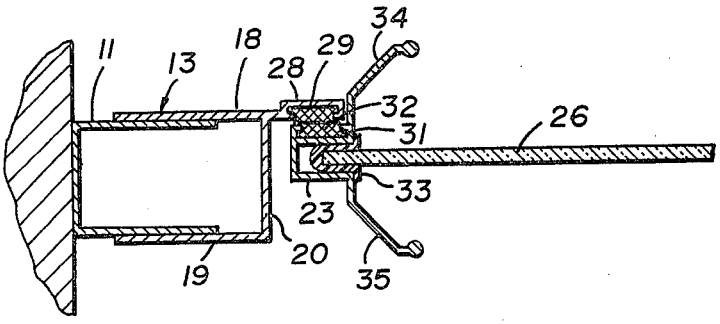
FIG. 3 is a cross-sectional view taken at the line 3—3 of FIG. 2, looking in the direction of the arrows.

Referring to FIGS. 1–4, a shower stall having a pivotal shower door according to the invention is shown and comprises a shower enclosure frame comprising a header 10, wall jambs 11 and 12, and an expander jamb 13 (FIG. 2). A sill 14 is mounted on the shower base 15. A drain 16 is provided in the center of the shower stall. A fixed panel 17 is mounted and formed of a material such as glass or plastics. The expander jamb 13 is formed of jamb members 18, 19 and 20 (FIG. 3).

A door 21 is mounted in the enclosure frame and comprises an upper door frame member 22, side frame members 23 and 24, and a lower door frame member 25. A panel 26 of glass or a plastic material is mounted in the door frame members.

Referring more particularly to FIG. 3, a portion of the wall jamb 11 and side frame member 23 are shown. The expander jamb 13 is comprised of expander jamb members 18, 19 and 20. The expander jamb 13 is provided with a magnet-retaining socket 28 having a magnet 29 retained therein. The side frame member 23 is also provided with a magnet-retaining socket 31 having a magnet 32 retained therein. An edge of the panel 26 is mounted in the side frame member 23 by means of a sealing gasket 33. Handles 34 and 35 are provided for opening and closing the door.

Figure 4:
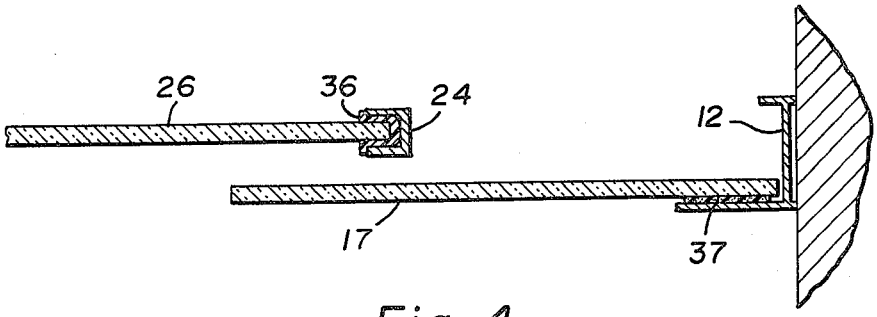
FIG. 4 is a cross-sectional view taken at the line 4—4 of FIG. 2, looking in the direction of the arrows.

Referring to FIG. 4, the side frame member 24 is shown having one edge of the panel 26 mounted therein by means of a sealing gasket 36. Also shown is the fixed panel 17 mounted by a seal 37 to the wall jamb 12.

Figure 5:
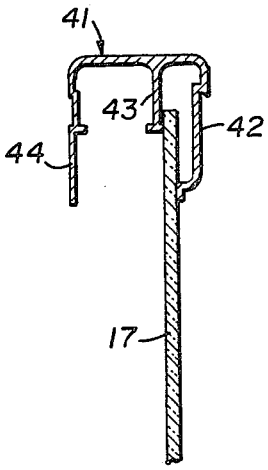
FIG. 5 is a cross-sectional view taken at the line 5—5 of FIG. 2, looking in the direction of the arrows.
Figure 6:
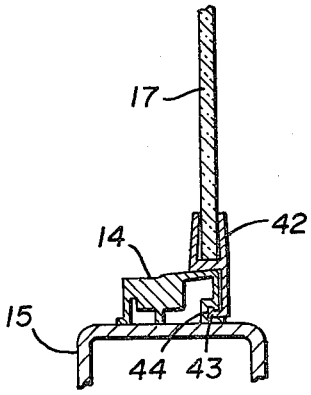
FIG. 6 is a cross-sectional view taken at the line 6—6 of FIG. 2, looking in the direction of the arrows.

Referring to FIGS. 5 and 6, the supporting members for the fixed panel 17 are shown and comprise a head track 41 having flanges 42, 43 and 44, and supporting the upper edge of the panel 17 between the flanges 42 and 43. The lower portion of the fixed panel 17 is mounted in a frame member 42 having a flange 43 mounted in a socket 44 of the sill 14.

Figure 7:
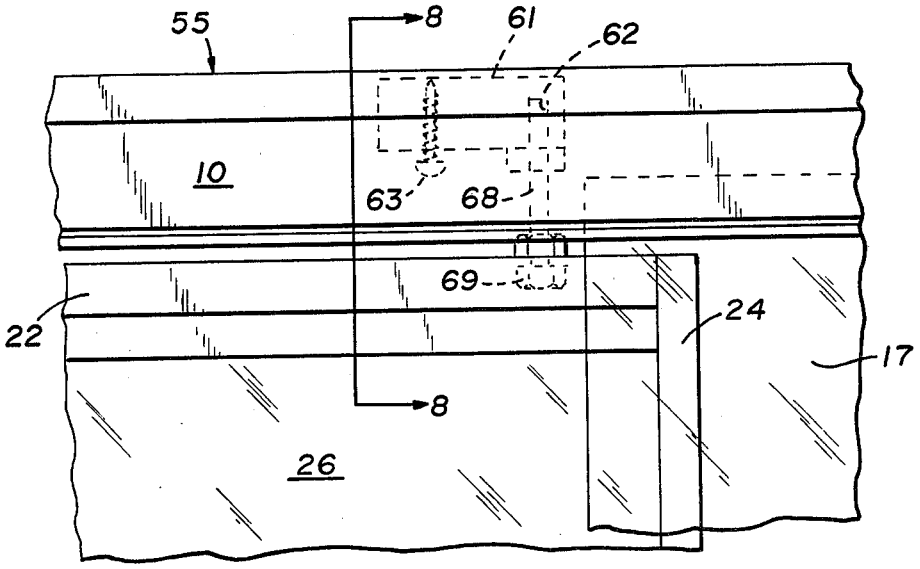
FIG. 7 is an enlarged elevational view of the top structure of the door and frame.
Figure 8:
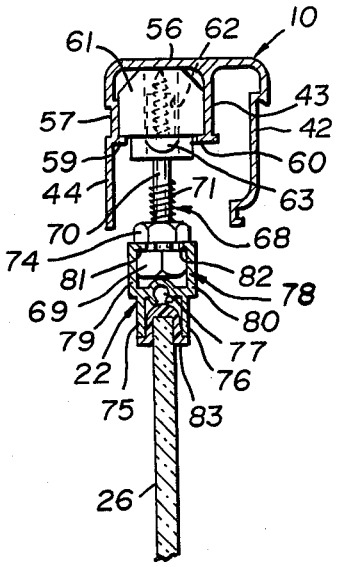
FIG. 8 is a cross-sectional view taken at the line 8—8 of FIG. 7.

Referring to FIGS. 7 and 8, the pivotal support for the upper portion of the door is shown. The head or upper track 10 comprises a top wall 56 and side walls 43 and 57 having converging lips 59 and 60 defining a track in which a pivot guide or socket 61 of a material such as nylon can slide. The pivot guide 61 is provided with a pivot opening 62 and locking screw 63.

An upper pivot member assembly 67 is also shown in FIGS. 7 and 8 comprising a bolt 68 having a head 69 and shank 70 and a threaded portion 71. A nut 74 is mounted on the threads 71. The head 69 should preferably be a square or hex head so that the bolt 68 cannot rotate.

As seen in FIG. 8, the upper door frame member 22 comprises flanges 75 and 76 and a screw-receiving socket 77. The frame member 22 also includes a converged track 78 comprising lateral flanges 79 and 80 having inwardly directed lips 81 and 82 defining a chamber with an upper slot. A sealing gasket 83 holds the panel 26 between the flanges 75 and 76. The head 69 of the bolt 68 is mounted inside the chamber of the track 78 and is affixed in place by means of the nut 74. The shank 70 extends through the slot, and the end of the shank is engaged in the pivot opening 62 of the pivot guide 61.

Figure 9:
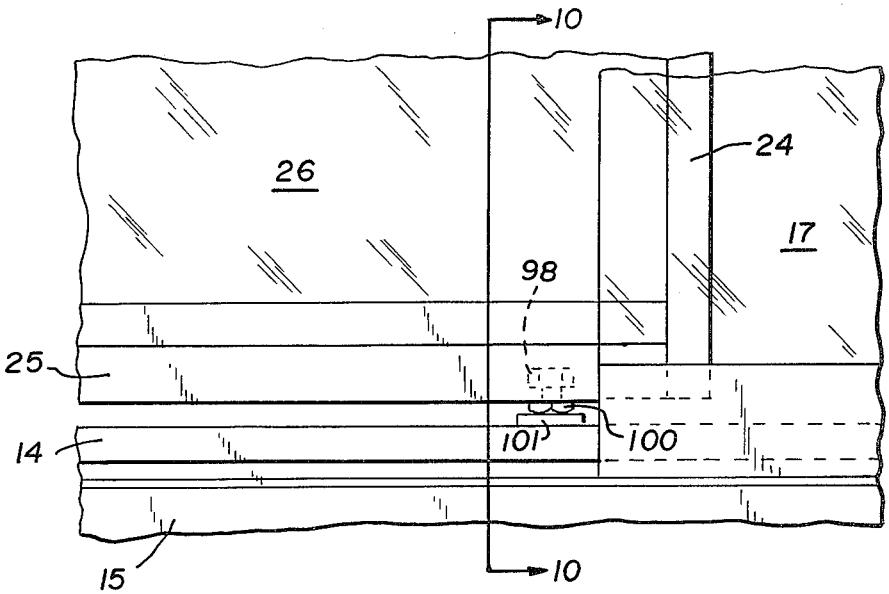
FIG. 9 is an enlarged elevational view of the lower portion of the pivotal door and frame assembly.
Figure 10:
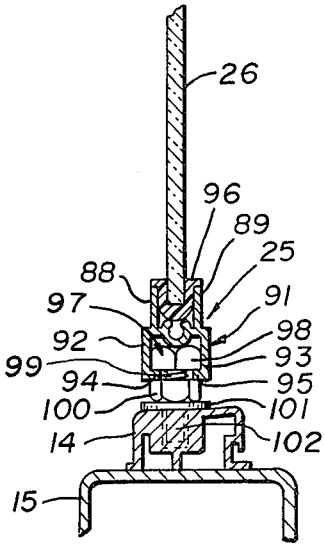
FIG. 10 is an enlarged cross-sectional view of a track utilized in the structure shown in FIG. 9.
Figure 11:
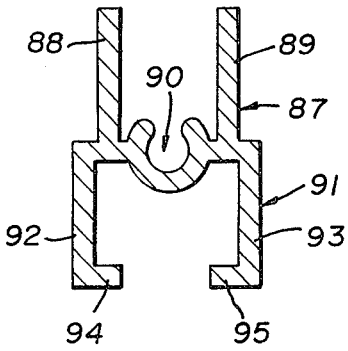
FIG. 11 is an enlarged cross-sectional view of the track shown in FIG. 10.

Referring to FIGS. 9, 10 and 11, the lower portion of the pivotal door and frame assembly is shown and comprises the bottom frame member 25 comprising flanges 88 and 89 and a screw-receiving socket 90. A track 91 is formed by side walls 92 and 93 having inwardly directed lips 94 and 95. A sealing gasket 96 is provided between flanges 88 and 89 for retaining the lower edge of the panel 26. A bolt 97 is provided having a head 98 mounted within the track 91 and a shank 102 having a threaded portion 99 with a nut 100 mounted thereon for securing the bolt in any desired position along the track. The end of the shank 102 of the bolt is pivotally mounted in the aperature of a plastic bushing 101 retained in the sill 14. The lower door frame member 25 is shown in somewhat enlarged view in FIG. 11.

In setting up the pivotally mounted doors of the present invention, a measurement is made of the opening width of the enclosure. The nuts 74 and 100 of the pivotal assemblies are loosened to permit the pivots 70 and 102 to slide within their respective tracks. The position of the pivots is adjusted so that the pivots are within the opening and spaced a distance from the edge of the fixed panel 17. The lower bushing 101 is fixed in the proper place, and the locking screw 63 loosened to permit the pivot guide 61 to slide to one side of the door. The lower pivot 102 is then inserted in the bushing 101 and the door positioned with the edge diagonal to the opening. The upper pivot guide 61 is then moved in its track until it engages the upper pivot 70. The pivot guide is moved along the track until the edge of the door reaches vertical position. The locking screw 63 may then be tightened to maintain the door in position for pivotal operation.

The pivotal door and the pivot structure of the present invention have a number of advantages over prior art structures. The same door can be utilized for openings of different widths, and the pivotal assemblies may be moved in their tracks until the desired position is reached. The assemblies may then fixed in place merely by tightening two nuts. The structure is strong, easily adjustable, and utilizes conventional easily obtained parts for its assembly. The cost of the structure is relatively low and very competitive with the cost of existing structures.

It is to be understood that the invention is not to be limited to the exact details of operation or structure shown and described in the specification and drawings, since obvious modifications and equivalents will be readily apparent to one skilled in the art.

What is claimed:

1. In combination a pivotal door for an entrance or passage way, and an enclosure frame, said pivotal door comprising:

(a) upper and lower door edges and a pair of side door edges, (b) said upper and lower door edges each having a channel track comprising a base and a pair of spaced-apart parallel flanges, said flanges terminating in a pair of lips directed towards each other, each of said lips having flat sides substantially parallel to each other and perpendicular to the sides of said flanges and cooperating to define with said base and flanges a channel chamber having an open slot, (c) a pair of pivot assemblies mounted one on each of the tracks of said upper and lower edges, each pivot assembly comprising a threaded bolt having an enlarged head engaged and slidably positioned in said channel chamber, said bolt extending through said open slot, nut means threadedly engaged with the threaded portion of said bolt and arranged to be tightened against the outer surfaces of the lips of said channel track for affixing said pivot assembly in any desired position on said channel track, said enclosure frame comprising a header, a pair of jambs, and a threshold, said header and threshold being provided with pivot socket means receiving the shanks of said pivot assemblies.

2. A combination according to claim 1, wherein said header is provided at its lower edge with a channel having a block with pivot socket means adjustably retained therein, and a set screw for affixing said block in any fixed position.

3. A combination according to claim 2, wherein said block is formed of a plastic material of low coefficient of friction.

4. A combination according to claim 1, wherein said door is retained in closed position by magnetic retainers.

5. A combination according to claim 1, wherein said door comprises upper and lower door frame members, a pair of side door frame members, and a panel retained by said door frame members.

6. A combination according to claim 1, wherein the head of said bolt is hexagonal and has dimensions permitting it to slide within said channel chamber, but not permitting it to rotate therein.

* * * * *